US005446451A

United States Patent [19]

Grosskopf, Jr.

[11] Patent Number: 5,446,451

[45] Date of Patent: Aug. 29, 1995

[54] ON BOARD HOT BEARING DETECTOR SYSTEM WITH FAULT DETECTION

[75] Inventor: George Grosskopf, Jr., Coram, N.Y.

[73] Assignee: Servo Corporation of America, Hicksville, N.Y.

[21] Appl. No.: 73,944

[22] Filed: Jun. 8, 1993

[51] Int. Cl.[6] ..... G08B 21/00; B61K 1/00

[52] U.S. Cl. ..... 340/682; 246/169 A

[58] Field of Search ..... 340/682, 514, 515, 516, 340/584; 246/169 A, 5

[56] References Cited

U.S. PATENT DOCUMENTS

| | | | |
|---|---|---|---|
| 3,792,434 | 2/1974 | Williams | 246/169 A |
| 4,029,859 | 6/1977 | Armstrong et al. | 246/169 A |
| 4,283,720 | 8/1981 | Herledan | 340/516 |
| 4,323,211 | 4/1982 | Bambara et al. | 340/682 |
| 4,528,458 | 7/1985 | Nelson et al. | 340/516 |
| 4,774,669 | 9/1988 | Schmitz et al. | 246/5 |
| 4,928,910 | 5/1990 | Utterback et al. | 340/682 |
| 5,168,261 | 12/1992 | Weeks | 340/515 |
| 5,260,664 | 11/1993 | Graham | 340/514 |

*Primary Examiner*—John K. Peng
*Assistant Examiner*—Benjamin C. Lee
*Attorney, Agent, or Firm*—Kane, Dalsimer, Sullivan, Kurucz, Levy, Eisele and Richard

[57] ABSTRACT

An on-board hot bearing detector system includes a microprocessor and heat sensors mounted on the train cars for sensing the bearing temperatures. Diagnostic circuitry is also provided to monitor the sensors and detect if a sensor is open or short. Additionally, the train line is controlled by the microprocessor and is provided with a current limiting device for protection against large currents in case of a short.

2 Claims, 3 Drawing Sheets

ON BOARD HOT BEARING DETECTOR SYSTEM WITH FAULT DETECTION

BACKGROUND OF THE INVENTION

A. Field of invention

This invention pertains to hot bearing detector system mounted on board a railroad train for monitoring its wheel bearings. The system is controlled by a microprocessor which monitors various components thereof and generates a fault indication if one of the components malfunctions.

B. Description of the Prior Art

It has been recognized in the railroad industry for a long time that the temperature of bearings on a train must be monitored to insure that an overheated bearing is detected before it breaks down. One such system for monitoring the train bearings consists of positioning stationary temperature sensors along the right-of-way. These detectors monitor the wheel bearings of passing trains, and if a hot bearing is sensed, an alarm signal is generated, usually at a remote location. This system is disadvantageous in that a large number of such detectors is required. Additionally, communication channels must be provided between the detectors and the remote location.

It has also been suggested that the sensors be mounted directly on the cars themselves. However, this on-board system has a rather complex structure which is difficult to trouble shoot in case of failures. Moreover, such systems become ineffective if the sensors themselves become inoperational.

OBJECTIVES AND SUMMARY OF THE INVENTION

In view of the above-mentioned disadvantages of the prior art, it is an objective of the present invention to provide an on-board hot bearing detector system controlled by a microprocessor with self-diagnostic capabilities.

A further objective is to provide a system which monitors various elements of the system on a continuous or regular basis, and which generates an alarm when one of said elements malfunctions.

Finally, a further objective is to provide a system with self diagnostics which monitors a train line and automatically detects a train line short and adjusts its impedance accordingly.

Other objectives and advantages shall become apparent from the following description of the invention. Briefly, a hot bearing detector system constructed in accordance with this invention includes a microprocessor, bearing temperature sensors mounted on the individual cars for monitoring the temperature of the bearings and interfacing circuitry for feeding the sensor outputs to the microprocessor. Since the sensors generate analog signals, the interface circuitry includes an A/D converter. The system also includes diagnostic circuitry which is used by the microprocessor to monitor the status of the sensors and other external components of the system including the wiring used to feed the sensor signals to the A/D converter. Through this diagnostic circuitry the microprocessor checks the sensors at regular intervals to determine if the sensors or the wiring is opened or short.

Additionally, the microprocessor is used to control other functions including the train line land the red locker light through interfacing relays. The train line is provided with a series current limiting element which automatically limits the current level through the train line for protection from high currents in case of train line shorts. The current limiting device also insures that in case of a short the fuse or breaker feeding power to the train line does not open and hence does not have to be reset or replaced manually.

DETAILED DESCRIPTION OF THE INVENTION

Figure 1:
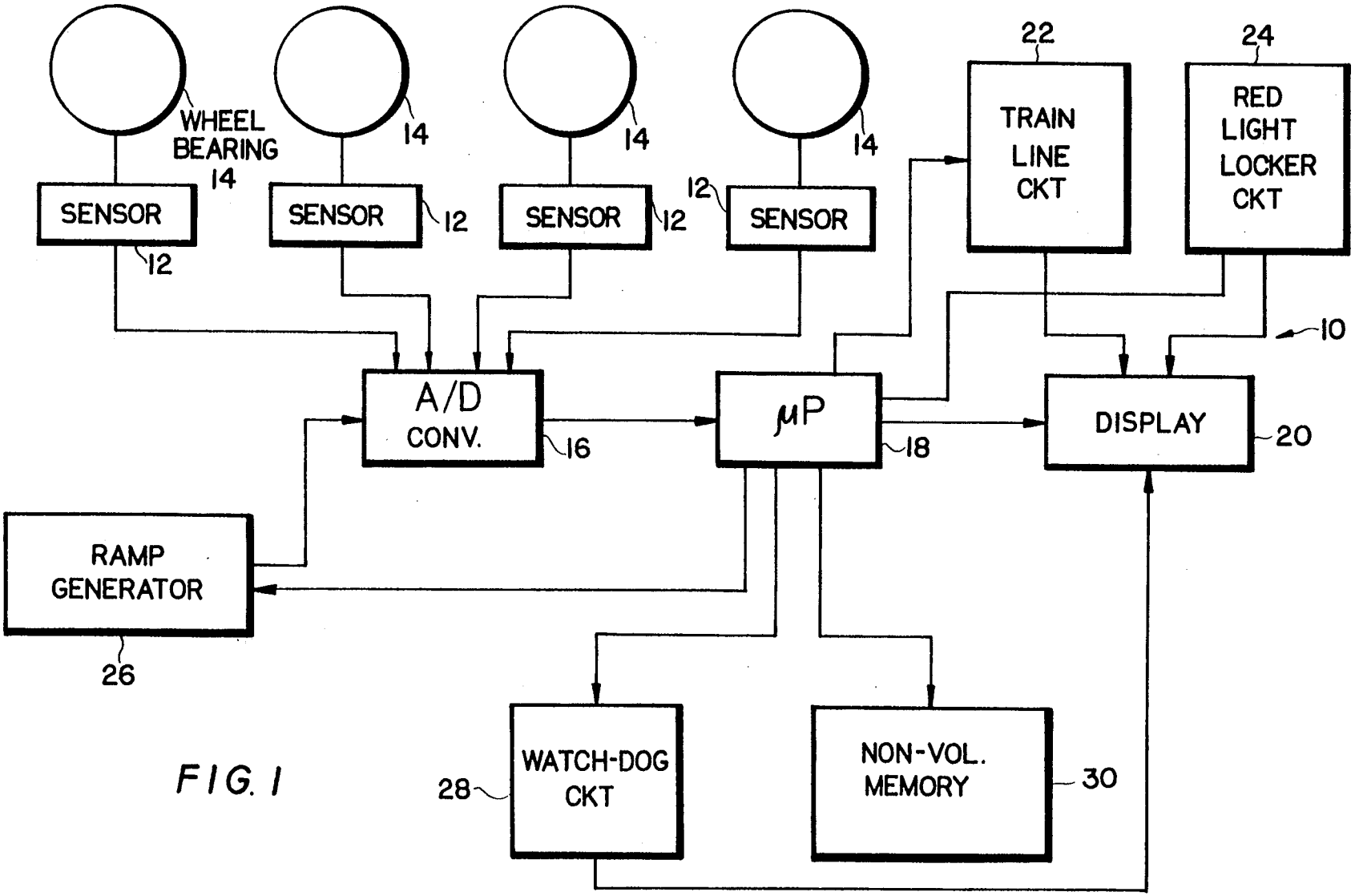
FIG. 1 shows a blocked diagram of an on-board hot wheel bearing detector system constructed in accordance with this invention.

Referring now to the drawings, and more particularly to FIG. 1, the on-board hot bearing detector system 10 constructed in accordance with this invention consists of a plurality of temperature sensors 12, each sensor being arranged and constructed to sense the temperature of a wheel bearing 14. There is at least one sensor 12 associated with each bearing on the train. One skilled in the art will appreciate that while the present invention is described in detail in relation to the detection of hot wheel bearings, the system may also be used to monitor other train components. For example, similar sensors may be used to monitor the temperature of the wheel rims to detect overheated wheels caused by faulty brake shoes.

Normally, sensors 12 produce an analog signal corresponding to the temperature of the bearing 14 being monitored. The analog signals from the sensors 12 are fed to an A/D converter 16. Converter 16 converts these signals into digital signals which are fed to microprocessor 18. The microprocessor 18 analyzes these signals to determine if one or more bearings are hot. The status of the bearings is displayed on an LED display 20 controlled by microprocessor 18. In addition, a relay operated train line circuit 22 and a red locker circuit 24 are provided which are also controlled by microprocessor 18.

The display panel 20 also has display elements indicating the status of the train line circuit, and the red locker circuit as described more fully below.

Preferably, the microprocessor 18, the display panel 20, and the A/D converter 16 are disposed in a common housing, for example in the locomotive cab. As previously described, the system 10 includes self-diagnostic circuitry to determine whether its various components are functioning properly. To this end, the system includes a ramp generator 26 which in response to commands from the microprocessor 18 generated at preset intervals, provides a step-wise increasing ramp signal to the A/D converter 16. The microprocessor analyzes the output of the converter 16 responsive to the ramp signal from generator 26. If the output of converter 16 does not reflect its input, the microprocessor 18 activates a corresponding element of display panel 20.

The system 10 further includes a watchdog circuit 28 consisting essentially of a timer. The microprocessor must send at a preset interval signals to the watchdog circuit 28 which resets its timer. If no signal is received by the watchdog circuit 28 within the preset period, the latter activates an indicator element on display panel 20 to indicate that the microprocessor is not functioning properly.

At regular intervals, microprocessor 18 feeds status information describing the various system components to a nonvolatile memory 30. If the system goes down and loses power because of a malfunction, when it is started up again, the last status information is recalled from memory 30 and displayed on display panel 20 thereby giving an indication as to what caused the malfunction. It should be understood that FIG. 1 is only a block diagram showing only some of the components of the system and the essential connections therebetween. Other components and/or connections have been omitted for the sake of, clarity.

Figure 2:
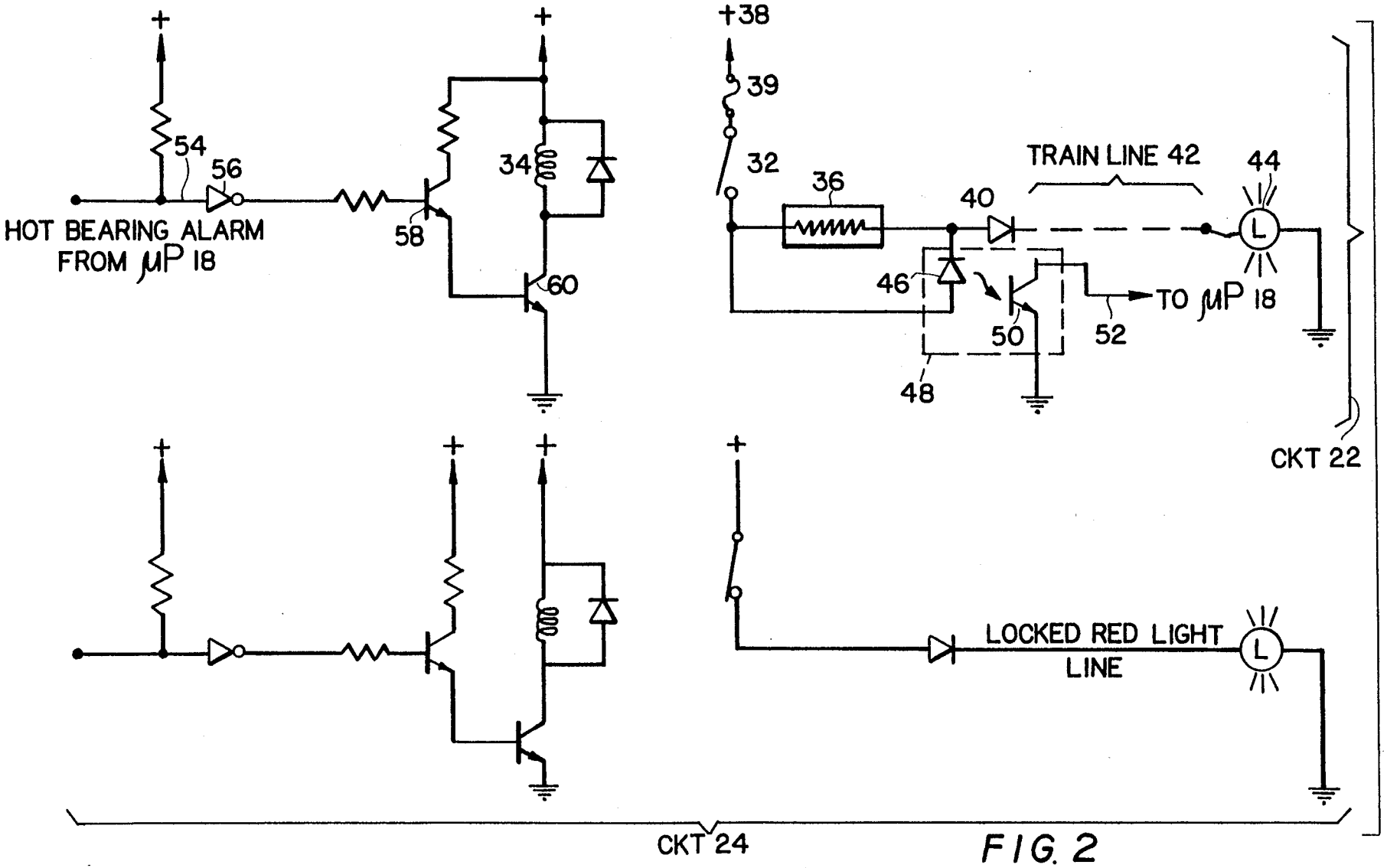
FIG. 2 shows a schematic diagram of the train line diagnostic circuitry.

Referring now to FIG. 2, the train line circuitry 22 consists of a normally closed relay contact 32 associated with a relay coil 34. When closed, contact 32 provides power from a power source 38 to a resistor 36 through a circuit protection device such as a fuse 39 or a circuit breaker. Preferably resistor 36 is a special resistor having a substantial positive temperature coefficient above a transition temperature. Thus, when the temperature of the resistor 36 exceeds the transistion temperature, its electrical resistivity also increases substantially. Below this transition temperature the resistance is very low. Resistors of this type are available for example from Siemens and Matsushita Components. From resistor 36 current from power source 38 flows through an isolating diode 40 and a conventional train line 42 to an indicator on display panel 20 and then to ground.

Connected in parallel with resistor 36 is a light emitting diode 46 which is incorporated into an optoisolator 48. Associated with diode 46 in optoisolator 48 is a phototransistor 50. Phototransistor 50 has its emitter grounded and its collector connected via line 52 to the microprocessor 18.

Circuitry 22 is also connected to the microprocessor 18 through a second line 54. The signals from this line 52 pass through an inverter 56 to the base of a transistor 58. Transistor 58 is coupled to a second transistor 60. Together, transistors 58 and 60 cooperate to operate the relay coil 34.

Circuit 22 operates as follows. Under normal conditions, the line 54 is grounded by the microprocessor 18. As a result, the output of inverter 56 is high, turning transistors 58 and 60 on. When transistor 60 is on, relay coil 34 is energized, contact 32 is open, and the train line 42 is deenergized.

If the microprocessor 18 detects a fault condition, which requires train line actuation, such as a hot bearing, the microprocessor raises the voltage on line 54 to a high level. This signal is inverted by inverter 56 causing transistors 58 and 60 to turn off and to deenergize relay 34, thereby closing contact 32. This in turn energizes the train line 42.

If any part of the train line is shorted while the train line is activated, the current flow through the resistor 36 starts increasing. However, an increase in current through this resistor 36 raises its temperature, thereby raising its resistance. As a result the net series resistance of the train line circuit is increased thereby reducing the current flow therethrough. In this manner the current through the train line circuit is automatically limited by resistor 36 and the circuit protection device 39 does not open but acts merely as a backup. In prior art train line circuits without the special resistor 36, excessive current causes the circuit protection device 39 to open. As a result, the train line is not operational until the circuit protection device 39 is manual replaced (in case of a fuse) or reset (in case of a circuit breaker). Additionally, in prior art train line circuitry large short currents may damage the components operated by the train line before the protection device 39 has a chance to open.

The voltage across the resistor 36 is monitored by diode 46. If this voltage, proportional to the train line circuit current, exceeds a preselected limit, diode 46 turns transistor 50 on which in turn grounds line 52 indicating to the microprocessor that a train line short has been detected. The microprocessor in turn activates an element on display panel 20. In addition, the microprocessor at regular intervals energizes relay coil 34 thereby de-activating the train line. After one or more of these pulses the short may clear. At the same time, since the instantaneous current through the train line circuit is automatically limited, the train line may be safely activated or engaged without damaging the components operated by the train line. If the short on the train line is not cleared within a preset time period, the microprocessor logs a fault train line in memory 30 so that corrective measures can be taken at a later date.

As shown in FIG. 2, the locker red bight circuit 24 is similar to the train line circuit 22 but it is not provided with a special resistor like resistor 36.

A problem with relatively complex microprocessor control systems is that it is difficult to establish whether a system failure occurs because of a faulty microprocessor itself, the internal components interfacing the microprocessor with the external components, or the external components. Thus, for example if a hot bearing detector system without diagnostic circuitry fails by generating a false hot bearing indication or because it fails to detect a hot bearing, the fault could be generated by the microprocessor, the internal interface circuits short or open wiring, or the A/D converter, or the external components such as the external wiring or the sensors 12. Without diagnostic circuitry, a fault caused by an external component may appear to be generated by an internal component. Hence a technician trying to repair the system may spend valuable time performing tests on the internal components which are inconsequential land unnecessary.

As described above, in order to prevent such occurrences in the present system the operation of the microprocessor is monitored by the watchdog circuit. The operation of the A/D converter 16 and its connections to the microprocessor 18 are checked periodically using the ramp generator 26.

Figure 3:
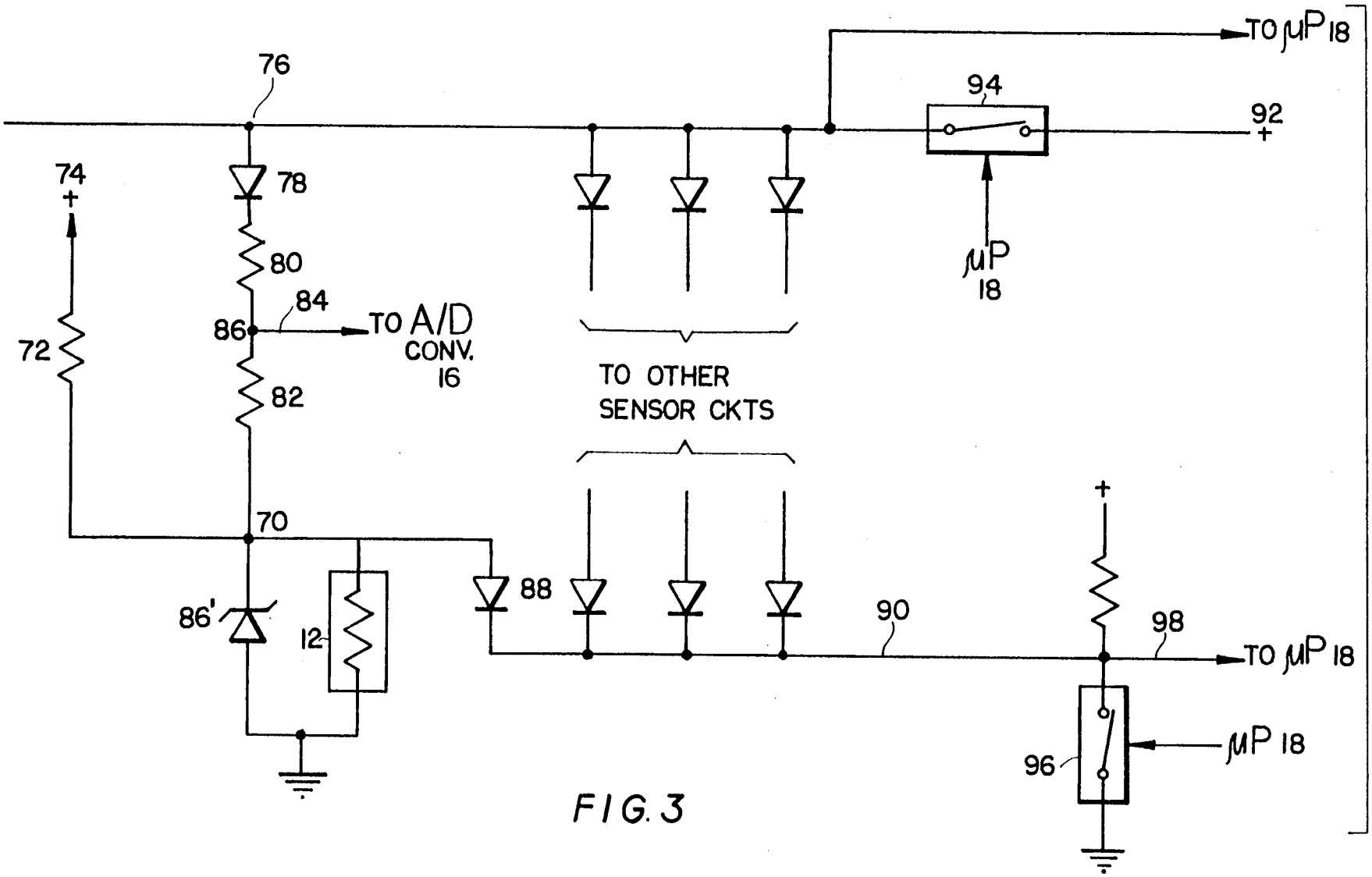
FIG. 3 shows a schematic diagram of the temperature sensor diagnostic circuitry.

The additional self-diagnostic circuitry for the external components including the sensors 12 and their external wiring is now described in conjunction with FIG. 3. In this figure one of the sensors 12 is represented as a resistor having one side grounded and the other side connected to a node 70. Node 70 is also connected through a resistor 72 to one power supply 74. The node 70 is further connected to a bus 76 through a diode 78 and two series resistors 80, 82. A line 84 leads from the node 86 between resistors 80, 82 to the A/D converter 16 to provide the response of the sensor 12. A zener diode 86' is used to limit the voltage of node 70 (and hence sensor 12 to a preselected value). The bus 76 is also connected to the A/D converter 16 to enable the microprocessor 18 to verify the operation of switch 94.

Node 70 is also connected through a diode 88 to a short circuit bus 90. As shown in FIG. 3, bus 76 is connected to other identical circuits through diodes 78 and to a power supply 92 through an electronic switch 94 controlled by microprocessor 18. Similarly, short circuit bus 90 is connected to ground through another electronic switch 96 also controlled by microprocessor 18. Other sensor circuits are connected to bus 90 via other diodes 88. A line 98 leads from bus 90 to microprocessor 18.

Under normal operating conditions, switch 94 is closed, and switch 96 is open. Under these conditions, the resistive network of resistors 80, 82 and sensor 12 form a voltage divider generating a voltage on line 84 related to the resistance and hence temperature sensed by sensor 12. This voltage, after conversion, is fed to the microprocessor 18 which to determine if the corresponding bearing has an acceptable temperature.

If the sensor 12 becomes shorted, the microprocessor 12 can sense it by the voltage produced on line 84. Similarly, if the sensor opens, the voltage on line 84 rises essentially to the output of power supply 92.

In addition, the microprocessor at regular intervals simulates an open and a short condition respectively to determine if the external wiring is intact. An open condition is simulated by opening switch 94. In this case voltage to line 84 is provided by source 74 through resistor 72 and the microprocessor can determine if all the sensors are correctly wired by checking each of the lines 84. A short is simulated by closing switch 96 thereby grounding bus 90 and closing switch 94. Again, by checking the voltage of each of the lines 84, the microprocessor can confirm if the sensors are wired correctly. When the microprocessor 18 closes electronic switch 94 the voltage on bus 76 is converted by the A/D converter 16, thereby allowing the microprocessor 18 to verify the performance of electronic switch 94 and supply 92. The microprocessor 18 closes the electronic switch 96 which produces a short circuit across sensor 12. Under these conditions, the resistive network of resistors 80 and 82 produce a specific voltage divider circuit which in turn produces an exact voltage at node 86. The voltage at node 86 is converted by the A/D converter 16 and read by the microprocessor 18. If this value is not within a predetermined tolerance a fault exists within the equipment 10. After verifying of equipment 10 is operational, the microprocessor 18 is capable of accurately determining if sensor are operational.

In this manner, the microprocessor 18 receives and determines not only the temperature of the bearings but by performing periodic checks, can also monitor the condition of the sensors, and the external wiring, the A/D converter, and so on. In addition, the circuitry of FIG. 2 is used not only to monitor the train line but also to automatically limit the train line current thereby insuring that the circuit protection device is not opened.

Obviously numerous modifications may be made to the invention without departing form its scope as defined in the appended claims.

I claim:

1. An on-board train monitoring system for monitoring wheel bearings distributed throughout a train, said system comprising:

a plurality of temperature sensors for sensing a temperature of said bearings;

a microprocessor coupled to said sensors for determining a status of said bearings from said temperature; and a train line circuit activated by said microprocessor if said temperature is excessive, said train line circuit including a power source, a train line, a resistive component feeding current from said power source to said train line, and a component monitoring means for monitoring said current, said resistive component including a resistor having a positive temperature coefficient and a temperature dependent on said current to regulate said current for protecting said train line circuit, and said component monitoring means generating an alarm signal if said current is excessive, said alarm signal being fed to said microprocessor;

wherein said microprocessor cyclically activates and deactivates said line circuit in response to said alarm signal.

2. An on-board detector system for monitoring the temperatures of train bearings comprising:

a power source;

a plurality of sensors mounted on said train arranged and constructed to generate sensor signals indicative of said bearing temperatures;

a microprocessor for identifying bearings having excessive temperatures;

interfacing means for feeding said sensor signals to said microprocessor; and diagnostic circuitry in communication with said microprocessor for monitoring a status of said sensors;

said diagnostic circuitry including a plurality of sensor resistors, each sensor resistor being coupled between one of said sensors and a voltage bus and a switch for connecting said power source to said voltage bus, said switch being selectively activated by said microprocessor;

a train line circuit including a relay selectively activated by said microprocessor and a train line controlled by said relay, said train line circuit further including a current limiting element for controlling a current level through said train line, said current limiting element including a current limiting resistor having a positive temperature coefficient;

a current monitoring means for monitoring said current level;

wherein said current monitoring means is coupled to said microprocessor, said microprocessor cyclically activating and deactivating said relay when said current level is excessive.

* * * * *